US005204199A

United States Patent [19]

Sugiuchi et al.

[11] Patent Number: 5,204,199

[45] Date of Patent: Apr. 20, 1993

[54] ELECTROPHOTOGRAPHIC RECEPTOR HAVING EXCELLENT CHARGING CHARACTERISTIC, PHOTOSENSITIVITY, AND RESIDUAL POTENTIAL

[75] Inventors: Masami Sugiuchi, Yokohama; Hideyuki Nishizawa, Tokyo, both of Japan

[73] Assignee: Kabushiki Kaisha Toshiba, Kawasaki, Japan

[21] Appl. No.: 586,308

[22] Filed: Sep. 21, 1990

[30] Foreign Application Priority Data

Sep. 22, 1989 [JP] Japan ..... 1-244964

[51] Int. Cl.[5] ..... G03G 5/047

[52] U.S. Cl. ..... 430/58; 430/59

[58] Field of Search ..... 430/58, 59

[56] References Cited

U.S. PATENT DOCUMENTS 4,418,132 11/1983 Yamazaki ..... 430/57
4,641,158 2/1987 Takeuchi ..... 346/160
4,804,602 2/1989 Buettner et al. ..... 430/42
4,971,875 11/1990 Gregory et al. ..... 430/59

FOREIGN PATENT DOCUMENTS 323553 7/1989 European Pat. Off. .
58-198043 11/1983 Japan .
2151223 7/1985 United Kingdom .

*Primary Examiner*—John Goodrow
*Attorney, Agent, or Firm*—Oblon, Spivak, McClelland, Maier & Neustadt

[57] ABSTRACT

An electrophotographic receptor includes a conductive support, and a photoconductive layer formed on the conductive support, wherein a minimum electric field strength required for a waveform, which indicates a change in photocurrent generated when a voltage is applied to and a light pulse is radiated on the photoconductive layer with respect to a time, to have a single peak and an upwardly projecting shape is 200 kV/cm or less. The photoconductive layer is constituted by a charge generating layer containing a charge generating substance and a charge transporting layer containing a charge transporting substance. The waveform characteristic of the photoconductive layer can be adjusted by the type and amount of the charge generating substance, the charge transporting substance, or a binder, and a method of manufacturing the charge transporting substance.

16 Claims, 4 Drawing Sheets

ELECTROPHOTOGRAPHIC RECEPTOR HAVING EXCELLENT CHARGING CHARACTERISTIC, PHOTOSENSITIVITY, AND RESIDUAL POTENTIAL

BACKGROUND OF THE INVENTION

1. Field of the Invention

The present invention relates to an electrophotographic receptor and, more particularly, to an electrophotographic receptor which is excellent in charging characteristic, photosensitivity, and residual potential characteristic and in which the characteristics are not degraded even after it is repeatedly used.

2. Description of the Related Art

An electrophotographic receptor generally has a structure in which a photoconductive layer (which may be a laminated member constituted by a charge generating layer containing a charge generating substance and a charge transporting layer containing a charge transporting substance) is formed on a conductive support. Conventionally, researches of charge generating and charge transporting substances have been individually made in many places in order to improve various characteristics of such substances.

Of these substances, the charge transporting substance must have a high charge injection efficiency and large charge mobility. In order to satisfy these requirements, various types of materials have been examined. However, no charge transporting substance having a good charging characteristic and high sensitivity and residual potential has been found.

For example, when 1,1-bis(p-dimethylaminophenyl)-4,4 diphenyl-1,3-butadiene described in -published Unexamined Japanese Patent Application No. 62-30255 is used as a charge transporting substance of a laminated electrophotographic receptor, although no change is found in potential characteristic even after the receptor is repeatedly electrified and exposed, image smearing occurs and resolution is reduced.

As described above, although extensive studies of charge generating and charge transporting substances have been made, no practically satisfactory electrophotographic receptor is obtained.

SUMMARY OF THE INVENTION

The present invention has been made to solve the above conventional problems, and has as its object to provide an electrophotographic receptor which improves a charging characteristic, photosensitivity, and residual potential characteristic by optimizing a receptor layer as a whole, in which changes in various characteristics are small even after the receptor is repeatedly used and the environment is changed, and which can provide high image quality similar to that obtained in an initial period even after the receptor is repeatedly used since image smearing does not occur and resolution is not reduced.

A photoconductive process of an electrophotographic receptor is constituted by a charge generating process in a charge generating layer, a charge injecting process in an interface between the charge generating layer and a charge transporting layer, and a charge transporting process in the charge transporting layer. The characteristics of the electrophotographic receptor, therefore, largely depend on selection and combination of a charge generating substance and a charge transporting substance to be used.

For this reason, the present inventors have made examinations on the basis of an assumption that optimization of a receptor layer as a whole is more important than optimization of each element such as a charge generating substance and have achieved the present invention.

According to the present invention, there is provided an electrophotographic receptor comprising a conductive support, and a receptor layer formed on the conductive support, wherein a minimum electric field strength required for a waveform, which indicates a change in photocurrent generated when a voltage is applied to and a light pulse is radiated on the receptor layer with respect to a time, to have a single peak and an upwardly projecting shape, is 200 kV/cm or less.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments of the present invention will be described below with reference to the accompanying drawings.

An electrophotographic receptor of the present invention comprises a photoconductive layer in which a minimum electric field strength required for a waveform, which indicates a change in photocurrent generated when a voltage is applied and a light pulse is radiated with respect to a time, to have a single peak and an upwardly projecting shape is 200 kV/cm or less.

Figure 1:
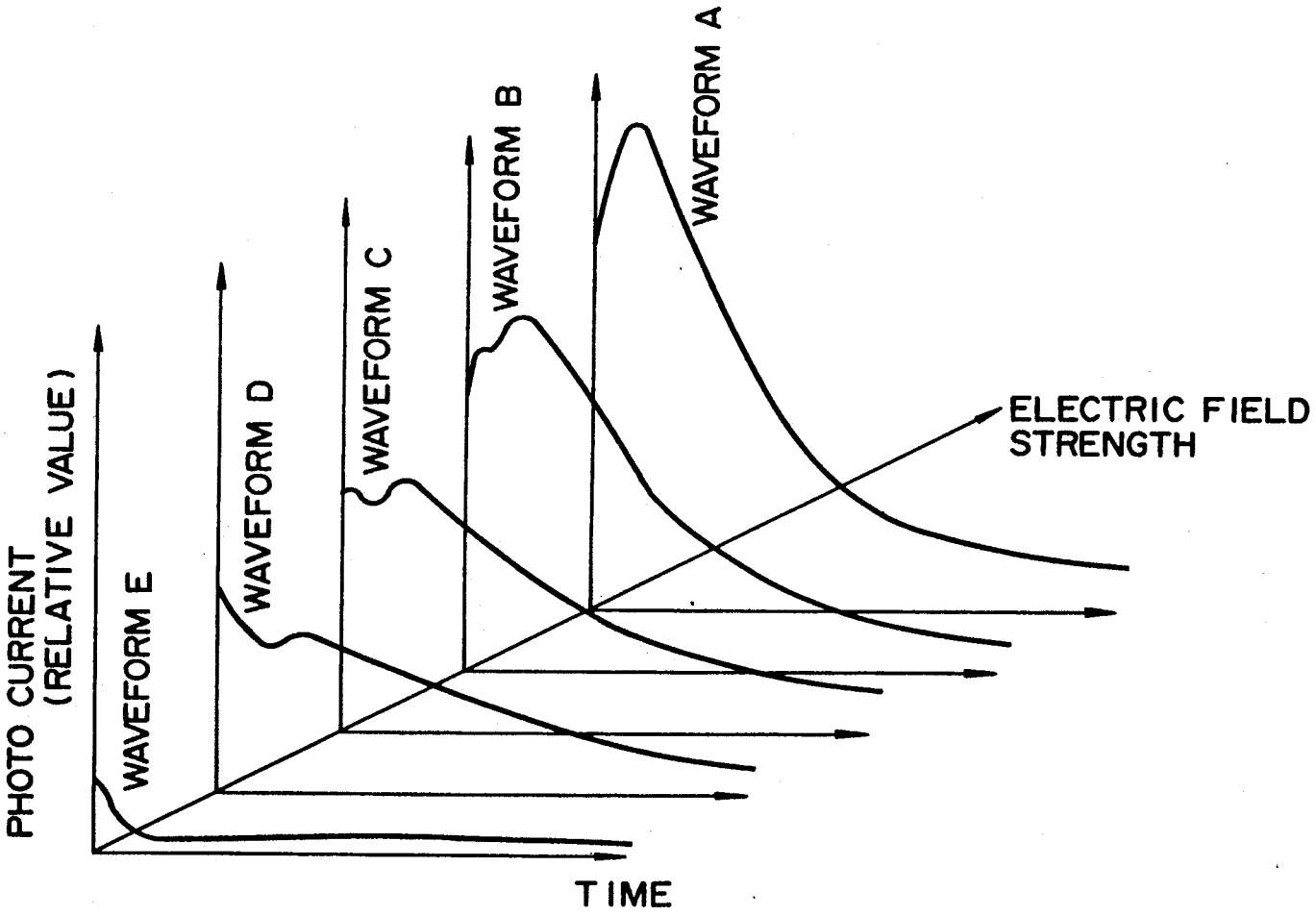
FIG. 1 is a graph showing a change in waveform of a photocurrent caused by electric field strength.

That is, in the electrophotographic receptor of the present invention, when a voltage is applied to and a light pulse is radiated on the photoconductive layer, a waveform indicating a change in photocurrent generated in this state with respect to a time changes from a waveform E to a waveform A shown in FIG. 1 as the strength of an electric field to be applied is increased. The electrophotographic receptor of the present invention comprises a photoconductive layer in which a minimum electric field strength for giving the waveform A is 200 kV/cm or less and therefore has excellent characteristics.

In the present invention, a radiation time of a light pulse to be radiated onto a sample is preferably much shorter than a relaxation time of the sample defined by a product of a capacitance and a resistance of the sample and is preferably much shorter than a time scale of a waveform of the obtained photocurrent.

In the present invention, although the size of the waveform of the obtained photocurrent changes when the intensity of radiated light is changed, its shape remains unchanged.

This waveform characteristic changes not only by properties of an individual element such as a charge transporting substance but also by a combination with, e.g., a binder for forming a photoconductive layer and a method of manufacturing the charge transporting substance. Therefore, the waveform characteristic of the photoconductive layer of the electrophotographic receptor can be set to satisfy the above range by adjusting these factors.

In order to obtain a receptor superior in especially sensitivity and residual potential, a minimum electric field strength is preferably 150 V/cm or less, and most preferably, 100 V/cm or less. Although the lower limit of the electric field strength is particularly not limited, it is normally 3 V/cm or more.

The present invention can be applied to an electrophotographic receptor of either of the following two types, i.e., a separated-function single-layer receptor containing at least a layer of each of a charge generating substance and a charge transporting substance, or a separated-function laminated receptor in which a charge generating layer and a charge transporting layer are sequentially laminated on a conductive substrate or a charge transporting layer and a charge generating layer, one or both of which is constituted by at least two layers, are sequentially laminated on a conductive substrate.

The present invention will be described in more detail below by taking a separated-function laminated receptor as an example.

A conductive support for use in the present invention is not particularly limited but may be any support which is normally used as a conductive support of an electrophotographic receptor. Examples of the support are metallic materials such as brass, aluminum, an aluminum alloy, gold, and silver; a support obtained by coating a thin plastic film on the surface of each of the above metals; and metal-coated paper, a metal-coated plastic sheet, and glass coated with a conductive layer consisting of, e.g., aluminum iodide, copper iodide, chromium oxide, or tin oxide. These supports are used as a cylindrical thin sheet plate having suitable thickness, hardness, and flexibility. Preferably, a support itself or its surface has conductivity and the support has satisfactory strength against processing.

A charge generating layer or a charge transporting layer to be described later is formed on such a conductive support.

A substance for forming the charge generating layer may be any substance as long as it is a charge generating substance which absorbs light and generates an electric charge (carrier) with high efficiency.

Examples of the charge generating substance are an inorganic photoconductor such as selenium, a selenium alloy, CdS, CdSe, CdSSe, ZnO, and ZnS; a phthalocyanine pigment such as metal phthalocyanine and nonmetallic phthalocyanine; an azo-based dye such as a monoazo dye and a disazo dye; a perylene-based pigment such as a perylene acid anhydride and perylene acid imide; an indigoid dye; a quinacridon pigment; a polycyclic quinone such as an anthraquinone and a pyrenequinone; a cyanine dye; a xanthene dye; a charge-transfer complex consisting of an electron donor substance such as poly-N-vinylcarbazole and an electron acceptor substance such as trinitrofluorenone; and a eutectic complex consisting of a pyrylium salt dye and a polycarbonate resin.

Although a method of forming a charge generating layer changes in accordance with the type of charge generating substance to be used, it can be arbitrarily selected from, e.g., various types of coating methods such as a spin coating method, a pulling method, a roller coating method, and a doctor blade coating method, a vacuum vapor deposition method, a sputtering method, and a plasma CVD method using glow discharge.

The thickness of a charge generating layer to be formed is arbitrarily determined in accordance with a charging characteristic required as an electrophotographic receptor. The thickness is, preferably, 0.01 to 20 μm, more preferably, 0.1 to 5 μm, most preferably, 0.2 to 5 μm.

When a charge generating layer is formed on a conductive support, an adhesive layer may be formed between the conductive support and the charge generating layer. As a substance for forming the adhesive layer, a substance such as casein which is conventionally often used can be used. The thickness of the adhesive layer is, preferably, 0.1 to 10 μm, and more preferably, 0.2 to 2 μm, most preferably 0.5 to 2 μm.

As a charge transporting substance usable in the present invention, a substance, which can transmit light in an amount sufficient to generate an electric charge in the charge generating layer upon radiation of light and can keep a desired charging potential when positive or negative charging, and particularly, negative charging is performed, can be used.

Examples of the substance are a hydrazone compound, a pyrazoline compound, an oxazole compound, an oxadiazole compound, a thiazole compound, a thiadiazole compound, an imino compound, a ketazine compound, an enamine compound, an amidine compound, a stilbene compound, a butadiene compound, and a carbazole compound.

An example of the charge transporting substance which can be suitably used in the present invention is a compound represented by the following formula:

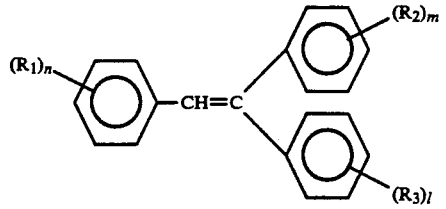

wherein each of R2 and R3 represents an alkyl group (preferably, C≦4) which may be substituted, an aralkyl group (preferably, C≦14), an aryl group (preferably, C≦18), a heterocyclic group, —O—$R_4$ (wherein $R_4$ represents an alkyl group (preferably, C≦4) which may be substituted, an aralkyl group (preferably, C≦14), an aryl group (preferably, C≦18), or a heterocyclic group,

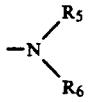

(wherein each of $R_5$ and $R_6$ represents an alkyl group (preferably, C≦4), which may be substituted, an aralkyl group (preferably, C≦14), or an aryl group (preferably, C≦18), or $R_5$ and $R_6$ together form an N-containing heterocylic ring), hydrogen, a halogen, a cyano group, or a nitro group.

Preferably, each of $R_2$ and $R_3$ represents an alkyl group (preferably, C≦4) which may be substituted, an aralkyl group (preferably, C≦14), —O—$R_4$ (wherein $R_4$ represents an alkyl group (preferably, C≦4), which may be substituted, an aralkyl group (preferably, C≦14), an aryl group (preferably, C≦18) or a heterocyclic group),

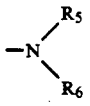

(wherein each of $R_5$ and $R_6$ represents an alkyl group (preferably, C≦4) which may be substituted, an aralkyl group (preferably, C≦14), or an aryl group (preferably, C≦18), or $R_5$ and $R_6$ together form an N-containing heterocyclic ring), hydrogen, or a halogen group.

More preferably, each of $R_2$ and $R_3$ represents —O—$R_4$ (wherein $R_4$ represents an alkyl group (preferably, C≦4) which may be substituted, an aralkyl group (preferably, C≦14), an aryl group (preferably, C≦18), or a heterocyclic group),

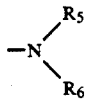

(wherein each of $R_5$ and $R_6$ represents an alkyl group (preferably, C≦4) which may be substituted, an aralkyl group (preferably, C≦14), or an aryl group (preferably, C≦18), or $R_5$ and $R_6$ together form an N-containing heterocyclic ring), hydrogen.

When neither $R_2$ nor $R_3$ is hydrogen, n=1, at least one of $R_2$ and $R_3$ is

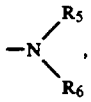

and neither $R_2$ nor $R_3$ is two or more

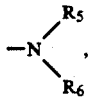

R1 represents an alkyl group in which C≧3 and which may be substituted, —O—$R_7$ (wherein $R_7$ represents an alkyl group in which C≧3 and which may be substituted, an aralkyl group, a heterocyclic group, or hydrogen), a cyano group, a nitro group, a halogen, an aryl group (preferably, C≦18) which may be substituted, or a heterocyclic group; when neither $R_2$ nor $R_3$ is hydrogen, n=1, and at least one of $R_2$ and $R_3$ is two or more

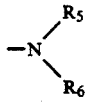

or when neither R2 nor R3 is

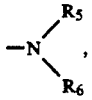

$R_1$ represents an alkyl group in which C≧2 and which may be substituted, —O—$R_7$, a cyano group, a nitro group, a halogen, an aryl group which may be substituted, or a heterocyclic group; when neither $R_2$ nor $R_3$ is hydrogen and n≧2, $R_1$ represents an alkyl group (preferably, C≦4) which may be substituted, an aralkyl group (preferably, C≦14), —O—$R_8$ (wherein $R_8$ represents an alkyl group (preferably, C≦4) which may be substituted, an aralkyl group (preferably, C≦14), an aryl group (preferably, C≦18), a heterocyclic group, or hydrogen), a cyano group, a nitro group, a halogen, hydrogen, an aryl group (preferably, C≦18) which may be substituted, or a heterocyclic group; when both $R_2$ and $R_3$ are hydrogen and n≦3, $R_1$ represents an aralkyl group (preferably, C≦14) which may be substituted, an aryl group (preferably, C≦18), a heterocyclic group, —O—$R_9$, (wherein $R_9$ represents an aralkyl group (preferably, C≦14), an aryl group (preferably, C≦18), or hydrogen), a cyano group, or a nitro group; and when both $R_2$ and $R_3$ are hydrogen and n>3, $R_1$ represents an alkyl group (preferably, C≦4) which may be substituted, an aralkyl group (preferably, C≦14), an aryl group (preferably, C≦18), a heterocyclic group, —O—$R_8$, a cyano group, a nitro group, a halogen, or hydrogen.

Preferably, when neither $R_2$ nor $R_3$ is hydrogen, n=1, a least one of $R_2$ and $R_3$ is

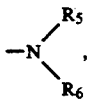

and neither $R_2$ nor R3 is two or more

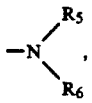

$R_1$ represents an alkyl group in which C≧3 and which may be substituted, —O—$R_7$ (wherein $R_7$ represents an alkyl group in which C≧3 and which may be substituted, an aralkyl group, a heterocyclic group, or hydrogen), a halogen, or an aryl group (preferably, C≦18) which may be substituted; when neither $R_2$ nor $R_3$ is hydrogen, n=1, and at least one of $R_2$ and $R_3$ is two or more

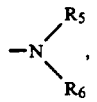

or neither $R_2$ nor $R_3$ is

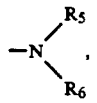

$R_1$ represents an alkyl group in which $C \geqq 2$ and which may be substituted, —O—$R_7$, a halogen, or hydrogen; and when neither $R_2$ nor $R_3$ are hydrogen and $n \geqq 2$, $R_1$ represents an alkyl group (preferably, $C \leqq 4$) which may be substituted, an aralkyl group (preferably, $C \leqq 14$), —O—$R_8$ (wherein $R_8$ represents an alkyl group (preferably, $C \leqq 4$) which may be substituted, an aralkyl group (preferably, $C \leqq 14$), an aryl group (preferably, $C \leqq 18$), a heterocyclic group, or hydrogen), a halogen, or hydrogen.

More preferably, when neither $R_2$ nor $R_3$ is hydrogen, $n=1$, at least or one of $R_2$ and $R_3$ is

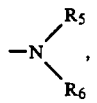

and neither $R_2$ nor $R_3$ is two or more

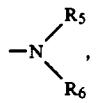

$R_1$ represents an alkyl group in which $C \geqq 3$ and which may be substituted, —O—$R_7$ (wherein $R_7$ represents an alkyl group in which $C \geqq 3$ and which may be substituted, an aralkyl group, a heterocyclic group, or hydrogen), or a halogen; when neither $R_2$ nor $R_3$ is hydrogen, $n=1$, and at least one of $R_2$ and $R_3$ is two or more

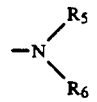

or neither R2 nor R3 is

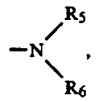

$R_1$ represents an alkyl group in which $C \geqq 2$ and which may be substituted, —O—$R_7$, or hydrogen; and when neither $R_2$ nor $R_3$ is hydrogen and $n \geqq 2$, $R_1$ represents an alkyl group (preferably, $C \leqq 4$) which may be substituted, an aralkyl group (preferably, $C \leqq 14$), —O—$R_8$ (wherein $R_8$ represents an alkyl group (preferably, $C \leqq 4$) which may be substituted, an aralkyl group (preferably, $C \leqq 14$), an aryl group (preferably, $C \leqq 18$), a heterocyclic group, or hydrogen), or a halogen.

In addition, $n=1$ to 5, $m=1$ to 5, and $l=1$ to 5.

Since none of the above charge transporting substances has film formation properties, a method of forming a charge transporting layer is preferably performed such that a polymer compound to be enumerated below is dissolved as a binder in a suitable organic solvent, the above charge transporting substance is dissolved or dispersed in the solvent to prepare a coating solution, and the coating solution is coated by a conventional coating method and dried.

Examples of a polymer compound serving as a binder are known polymer compounds as an electrophotographic receptor binder such as polycarbonate, polyestercarbonate, polystyrene, polyvinyl chloride, an acrylic resin, a vinyl chloride-vinyl acetate copolymer, polyvinyl acetate, polyvinyl acetal, a phenolic resin, a styrene-acryl copolymer, polyarylate, and an alkyd resin.

In this case, a mixing ratio of the polymer compound is preferably 0.3 to 2 parts by weight with respect to 1 part by weight of a charge transporting substance.

Examples of an organic solvent are an aliphatic chlorine-based solvent, an aromatic hydrocarbon-based solvent, an aromatic chlorine-based solvent, an ether-based solvent, an ester-based solvent, and a ketone-based solvent.

Examples of the coating method are a spin coating method, a pulling method, a roller coating method, and a doctor blade coating method.

The thickness of the charge transporting layer is determined such that the total thickness of the charge generating and transporting layers is preferably 100 μm or less, and more preferably, 10 to 30 μm. If the total thickness of the two layers exceeds 100 μm, flexibility and photosensitivity of a formed receptor layer may be reduced. Note that the thickness of only the charge transporting layer is preferably 10 to 30 μm.

A minimum electric field strength for giving a waveform A shown in FIG. 1 depends on not only the molecular structures of the charge generating substance, the binder, and the charge transporting substance but also their synthesizing and refining methods.

A surface layer consisting of an urethane resin or an acrylic copolymer can be formed on the above-mentioned photoconductive layer.

Examples of the present invention will be described below.

Figure 2:
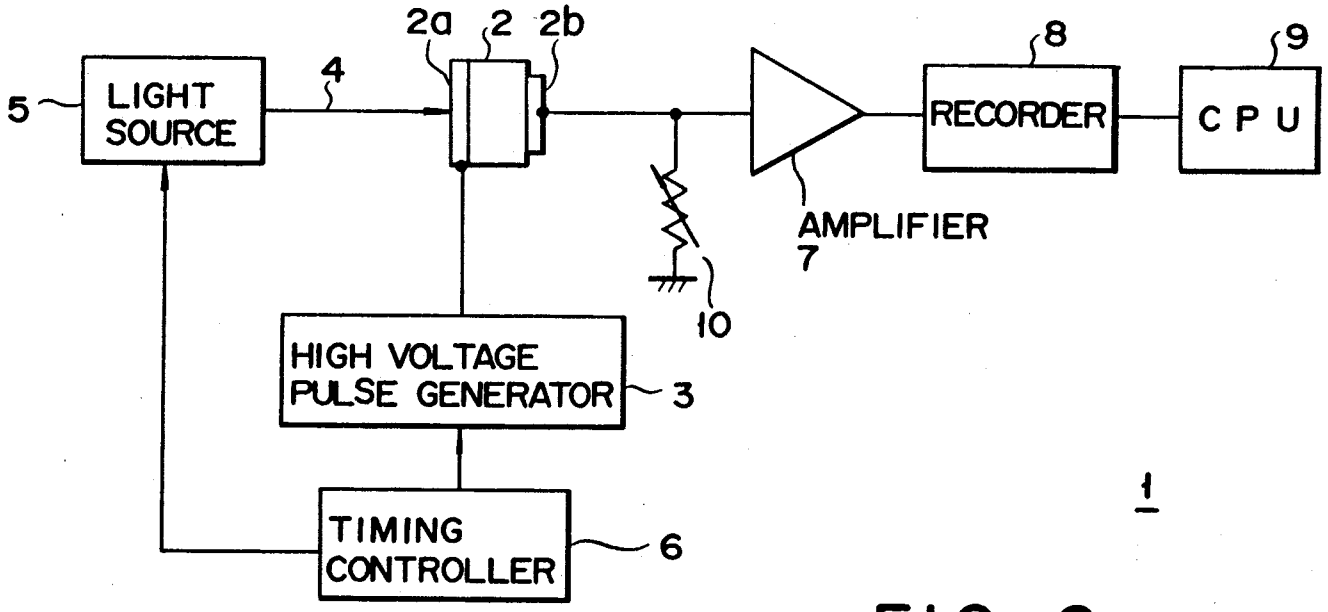
FIG. 2 is a block diagram showing a measurement apparatus used in an embodiment of the present invention.
Figure 3:
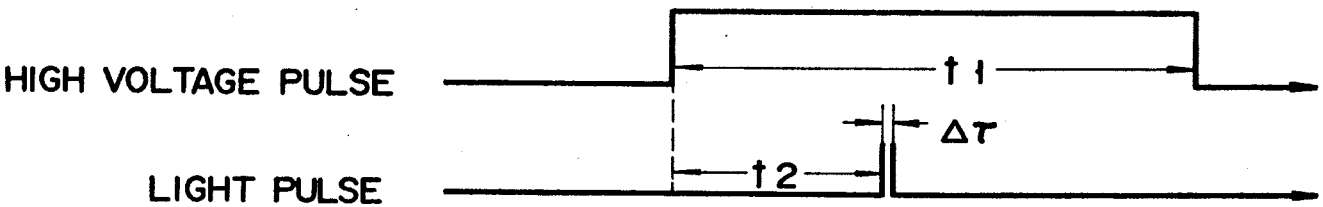
FIG. 3 is a timing chart showing waveforms of a high-voltage pulse and a light pulse.

FIG. 2 is a block diagram showing an arrangement of a measurement apparatus used for examples of the present invention. This measurement apparatus 1 has a high-voltage pulse generator 3 for generating a high-voltage pulse for applying an electric field to a sample 2 to be measured having a pair of electrodes 2*a* and 2*b*, and a light source 5, constituted by a xenon flash lamp, for radiating a light pulse 4 onto the sample 2. Note that the electrode 2*a* formed at the light pulse 4 incident side of the sample 2 is a transparent electrode such as an ITO substrate. The high-voltage pulse generator 3 and the light source 5 are controlled by a timing controller 6 so as to generate a high-voltage pulse having a pulse width $t_1$ and a light pulse having a pulse width $\Delta\tau$ after a time period $t_2$ elapses from the high-voltage pulse generation timing as shown in FIG. 3.

The apparatus 1 further includes a amplifier 7 for amplifying a transient photocurrent generated upon radiation of the light pulse 4 and a recorder 8 for recording a waveform of the amplified photocurrent which is attenuated over time. An example of the recorder 8 is a storage scope. Also, the apparatus 1 has a computer 9 for analyzing the waveform of the obtained photocurrent. In addition, an input resistor 10 is connected to the input side of the amplifier 7.

When the waveform of a photocurrent is to be measured by the measurement apparatus 1 having the above arrangement, the light pulse 4 is radiated from the light source 5 which is excited by an optical trigger from the timing controller 6 onto the sample on which an electric field having a predetermined strength by the high-voltage pulse from the high-voltage pulse generator 3. The transient photocurrent which is generated by the light pulse 4 and is attenuated as a generation time elapses is amplified by the amplifier 7. The waveform of the amplified photocurrent is recorded by the recorder 8 and analyzed by the computer 9.

Note that in this measurement apparatus, a change in waveform of the photocurrent is analyzed by using a computer. The waveform of the recorded photocurrent, however, can be analyzed by a naked eye instead of by a computer.

EXAMPLE 1

A compound 1 having the following formula was synthesized by using p-diphenylbenzaldehyde and diethyl 1,1-diphenylmethylphosphonate under four types of reaction conditions listed in Table 1 below.

Compound 1

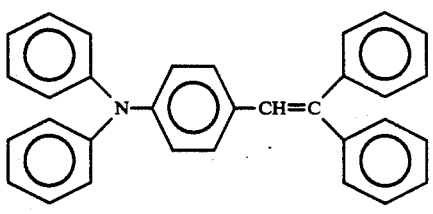

TABLE 1

| No. | Number of mols of P-diphenylbenzaldehyde | Number of mols of diethy-1,1-diphenyl-ethylphosophonate | Reaction Solvent | Catalyst | Reaction Temperature. Time |
|---|---|---|---|---|---|
| A | 0.1 | 0.11 | DMF 200 cc | t-BuOK (0.15 mol) | At 10° C. or less for 30 min. Thereafter, at 20° C. or less for 1 h. |
| B | 0.1 | 0.11 | DMF 100 cc ethanol 100 cc | t-BuOK (0.15 mol) | At 5° C. or less for 3 h. |
| C | 0.1 | 0.2 | DMF 200 cc | t-BuOK (0.3 mol) | At 10° C. or less for 30 min. Thereafter, at 20 C. or less for 1 h. |
| D | 0.1 | 0.11 | DMF 200 cc | t-BuOK (0.12 mol) | At 20° C. or less for 2 h. |

After the post-treatment, the obtained crystals were dissolved in solvents listed in Table 2 below to perform recrystallization twice, and the resultant materials were dried in vacuum at 80° C. for four hours, thereby obtaining four types of compounds A, B, C, and D.

TABLE 2

| No. | Recrystallizing Solvent |
|---|---|
| A | ethanol/1,4-dioxane |
| B | toluene/ethanol |
| C | toluene/n-hexane |

TABLE 2-continued

| No. | Recrystallizing Solvent |
|---|---|
| D | ethyl acetate/n-hexane |

Figure 5:
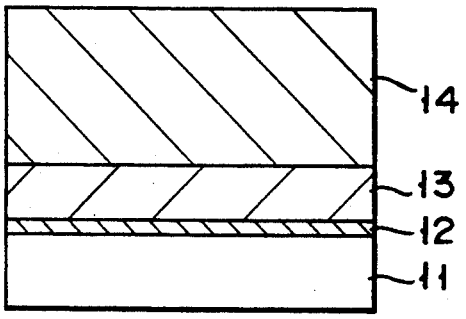
FIG. 5 is a sectional view showing an electrophotographic receptor according to one embodiment of the present invention.

As shown in FIG. 5, a polyethyleneterephthalate film 11 on which an aluminum film 12 was deposited was used as a conductive support, and a solution prepared by dispersing τ-nonmetallic phthalocyanine (1 part by weight) and a butyral resin (1 part by weight) in cyclohexanone was coated by a coating method on the surface on which the aluminum film 12 was formed by deposition, thereby forming a charge generating layer 13 having a thickness of 0.3 μm.

A solution prepared by dissolving each of the above four types of compounds A, B, C, and D and polycarbonate in methylene chloride was coated on the charge generating layer 13 by a pulling method and dried at 90° C. for 24 hours to form a 20 μm-thick charge transporting layer 14.

A charging characteristic (an initial value of the surface potential of a receptor obtained when it is charged), photosensitivity (an exposure amount required to attenuate the surface potential initial value to be ½), and a residual potential of each of the four types of receptors Nos. 1, 2, 3, and 4 obtained as described above were measured. The measurement results are listed in Table 3.

An Al electrode having a light transmittance of about 60% was formed as an upper transparent electrode on a 0.2 -μm thick ITO substrate (available from Matsuzaki Vacuum Co., Ltd) serving as a lower transparent electrode. A charge generating layer and a charge transporting layer were formed on the Al electrode following the same procedures as described above.

A metal electrode was formed on the film consisting of the material to be measured so as to obtain a sample to be measured. In this sample, the Al electrode and the charge generating layer consisting of τ-nonmetallic phthalocyanine form a Shottky junction, and a photocurrent to be measured consists of only carriers produced upon radiation of a light pulse since no carriers are injected from the Al electrode, thereby improving an S/N ratio.

A minimum electric field strength for giving the waveform A shown in FIG. 1 of each sample formed as described above was measured by using the above-mentioned measurement apparatus. The measurement results are also listed in Table 3.

When the receptors Nos. 1 and 2 having the above electric field strengths of 200 V/cm or less were repeatedly charged and exposed 10,000 times in an environment in which heat, ozone, and the like were generated, almost no abnormality was found, and variations in charged characteristic, photosensitivity, residual potential, and the like were small. That is, these receptors had a high fatigue resistance.

When the receptors Nos. 3 and 4 having the above electric field strengths exceeding 200 V/cm were repeatedly charged and exposed 10,000 times in the environment in which heat, ozone, and the like were generated, variations were found in charged characteristic, photosensitivity, residual potential, and the like. That is, these receptors were inferior in fatigue resistance to the receptors Nos. 1 and 2.

TABLE 3

| Receptor No. | Compound (1) | Minimum Electric Field Strength for Giving Waveform A in FIG. 3 (V/cm) | Charging Characteristic (V) | Photo-sensitivity (luX · sec) | Residual Potential (V) |
|---|---|---|---|---|---|
| 1 | B | 100 | −1300 | 1.5 | 0 |
| 2 | A | 200 | −1200 | 1.6 | 0 |
| 3 | C | 250 | −900 | 2.9 | 60 |
| 4 | D | 350 | −780 | 3.5 | 110 |

EXAMPLE 2

Electrophotographic receptors and electric field measurement samples were formed following the same procedures as in Example 1 except that dibromoanthoanthoron was used as a charge generating substance and 15 types of compounds listed in Table 4 were used as a charge transporting substance.

A charging characteristic, photosensitivity, a residual potential, and a minimum electric field strength for giving the waveform A shown in FIG. 1 of each receptor were measured. The measurement results are summarized in Table 4.

As is apparent from Table 4, when the receptors Nos. 1 to 7, 14, and 15 having the above electric field strengths of 200 V/cm or less were repeatedly charged and exposed 10,000 times in an environment in which heat, ozone, and the like were generated, almost no abnormality was found, and variations in charged characteristic, photosensitivity, residual potential, and the like were small. That is, these receptors had a high fatigue resistance.

When the receptors Nos. 8 to 13 having electric field strengths exceeding 200 V/cm were repeatedly charged and exposed 10,000 times in the environment in which heat, ozone, and the like were generated, variations were found in charging characteristic, photosensitivity, residual potential, and the like. That is, these receptors were inferior in fatigue resistance to the receptors Nos. 1 to 7, 14 and 15.

TABLE 4

| Receptor No. | Charge Transporting Substance No. | Minimum Electric Field Strength for Giving Waveform A in FIG. 3 (V/cm) | Charging Characteristic (V) | Light Attenuation (luXN · sec) | Residual Potential (V) |
|---|---|---|---|---|---|
| 1 | 13 | 100 | −1500 | 2.0 | 0 |
| 2 | 11 | 100 | −1600 | 2.1 | 0 |
| 3 | 10 | 150 | −1550 | 2.0 | 5 |
| 4 | 12 | 150 | −1630 | 2.2 | 0 |
| 5 | 1 | 200 | −1720 | 2.3 | 0 |
| 6 | 3 | 200 | −1400 | 2.1 | 10 |
| 7 | 4 | 200 | −1570 | 2.1 | 5 |
| 8 | 5 | 250 | −1050 | 2.9 | 30 |
| 9 | 7 | 250 | −1100 | 3.7 | 25 |
| 10 | 9 | 250 | −980 | 4.2 | 10 |
| 11 | 2 | 300 | −890 | 4.4 | 80 |
| 12 | 6 | 500 | −760 | 5.0 | 120 |
| 13 | 8 | 600 | −820 | 6.1 | 120 |
| 14 | 14 | 70 | −1540 | 1.8 | 0 |
| 15 | 15 | 60 | −1610 | 1.8 | 0 |

Figure 4:
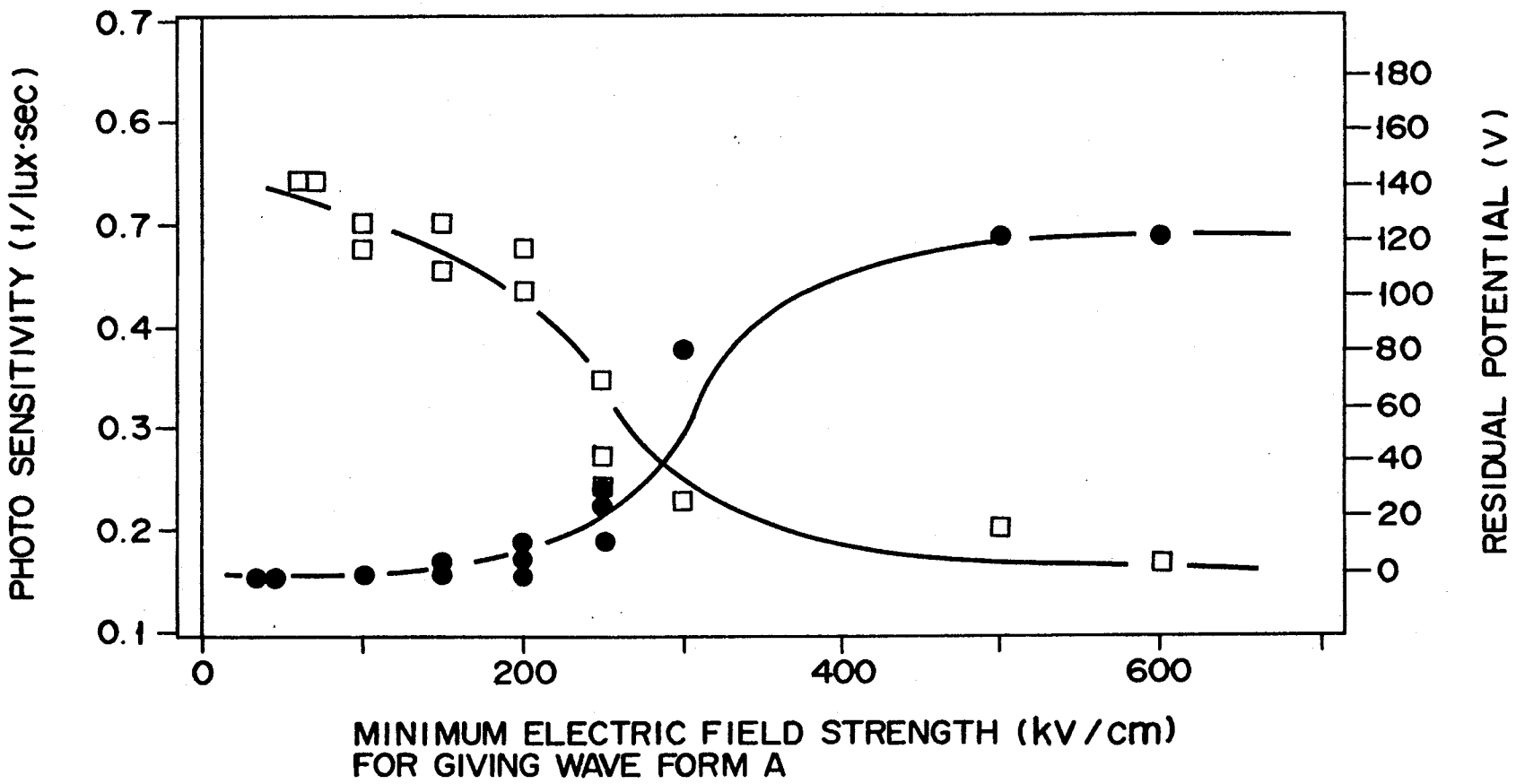
FIG. 4 is a graph showing changes in residual potential and photosensitivity with respect to a minimum electric field strength for giving a waveform A.

FIG. 4 shows the same contents as listed in Table 4 in the form of a graph. Referring to FIG. 4, reference symbol ● indicates a residual potential; and □, photosensitivity (a reciprocal of light attenuation).

Formulas of the charge transporting substances listed in Table 4 will be presented below.

1.

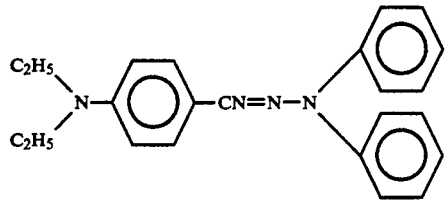

-continued
2.
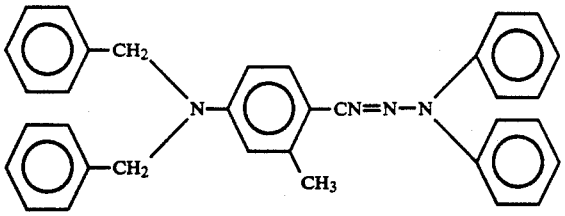
3.
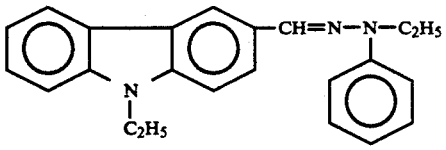
4.
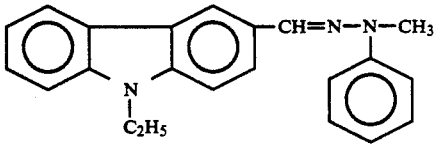
5.
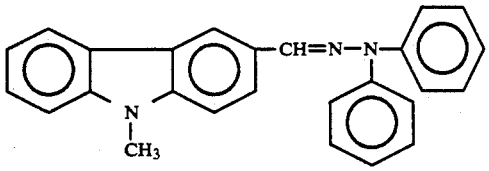
6.
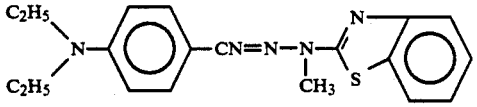
7.
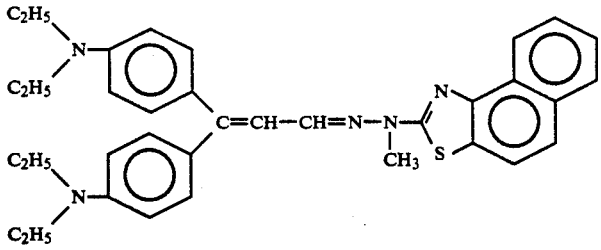
8.
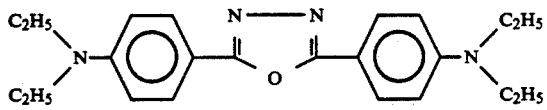
9.
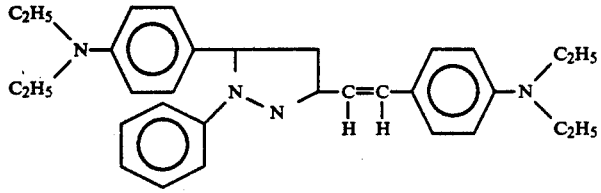

-continued
10.
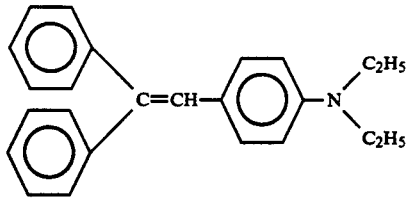
11.
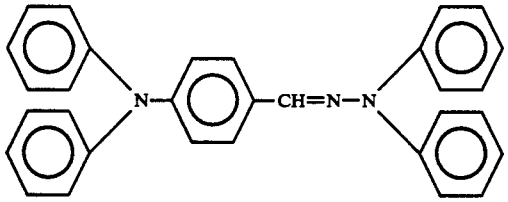
12.
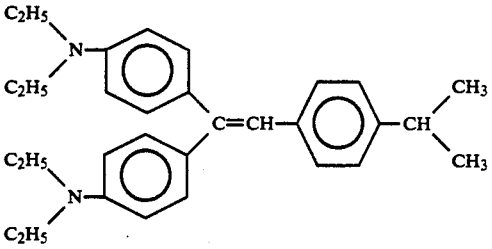
13.
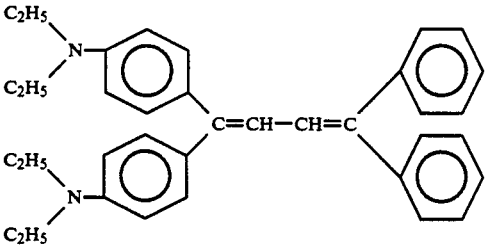
14.
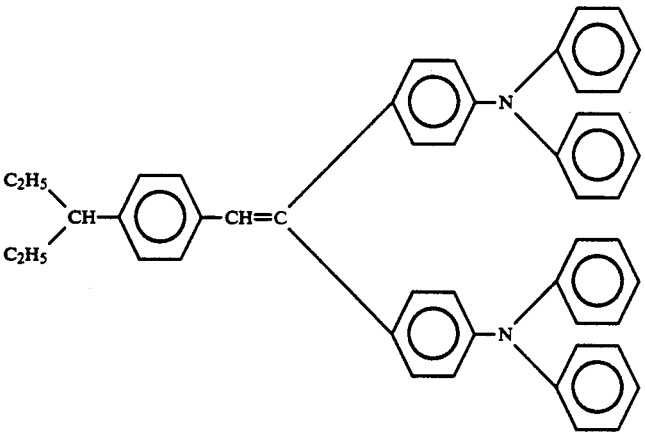

-continued

15.

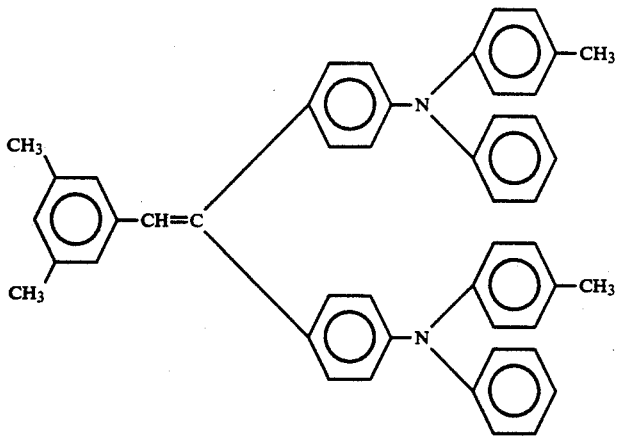

As has been described above, according to the present invention, by optimizing a photoconductive layer as a whole, an electrophotographic receptor which is excellent in charging characteristic, photosensitivity, and residual potential characteristic, in which changes in various characteristics are small even after the receptor is repeatedly used and the environment is changed, and which can provide high image quality similar to that obtained in an initial period since image smearing does not occur and resolution is not reduced even after the receptor is repeatedly used.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An electrophotographic receptor comprising:

a conductive support; and a photoconductive layer formed on said conductive support comprising a charge generating layer containing a charge generating substance and a charge transporting layer containing a charge transporting substance, wherein a minimum electric field strength required for a waveform, which indicates a change in photocurrent generated when a voltage is applied to and a light pulse is radiated on said photoconductive layer with respect to a time, to have a single peak and an upwardly projecting shape, is not more than 200 kV/cm, said charge generating substance is selected from the group consisting of an inorganic photoconductor, a phthalocyanine pigment, an azo-based dye, a perylene-based pigment, an indigoid dye, a quinacridon pigment, a polycyclic quinone, a cyanine dye, a xanthene dye, a charge-transfer complex consisting of an electron donor substance and an electron acceptor substance, and an eutectic complex consisting of pyrylium salt dye and a polycarbonate resin, and said charge transporting substance is selected from the group consisting of a hydrazone compound, a pyrazoline compound, an oxazole compound, an oxadiazole compound, a thiazole compound, an amino compound, a ketazine compound, an enamine compound, an amidine compound, a stilbene compound, a butadiene compound, and a carbazole compound.

2. A receptor according to claim 1, wherein the minimum electric field strength is 3 to 200 kV/cm.

3. A receptor according to claim 1, wherein the minimum electric field strength is 3 to 150 kV/cm.

4. A receptor according to claim 1, wherein the minimum electric field intensity is 3 to 100 kV/cm.

5. A receptor according to claim 1, wherein said charge transporting substance is a compound represented by the following formula:

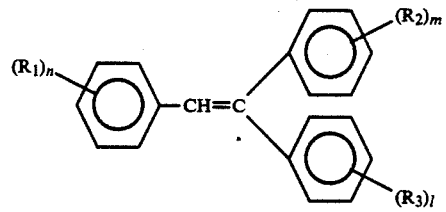

wherein each of $R_2$ and $R_3$ represents an alkyl group which may be substituted, an aralkyl group, an aryl group, a heterocyclic group, —O—$R_4$ (wherein $R_4$ represents an alkyl group which may be substituted, an aralkyl group, an aryl group, or a heterocyclic group),

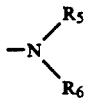

(wherein each of $R_5$ and $R_6$ represents an alkyl group which may be substituted, an aralkyl group, or an aryl group, or $R_5$ and $R_6$ together form an N-containing heterocyclic ring), hydrogen, a halogen, a cyano group, or a nitro group, when neither $R_2$ nor $R_3$ is hydrogen, n=1, at least one of $R_2$ and $R_3$ is

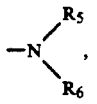

and neither $R_2$ nor $R_3$ is not less than two

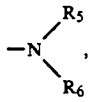

$R_1$, represents an alkyl group in which C≧3 and which may be substituted, —O—$R_7$ (wherein $R_7$ represents an alkyl group in which C≧3 and which may be substituted, an aralkyl group, a heterocyclic group, or hydrogen), a cyano group, a nitro group, a halogen, an aryl group which may be substituted, or a heterocyclic group; when neither $R_2$ nor $R_3$ is hydrogen, n=1, and at least one of $R_2$ and $R_3$ is not less than two

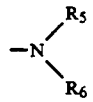

or neither $R_2$ nor $R_3$ is

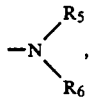

$R_1$ represents an alkyl group in which C≧2 and which may be substituted, —O—$R_7$, a cyano group, a nitro group, a halogen, an aryl group which may be substituted, or a heterocyclic group; when neither $R_2$ nor $R_3$ is hydrogen and n≧2, $R_1$ represents an alkyl group which may be substituted, an aralkyl group, —O—$R_8$ (wherein $R_8$ represents an alkyl group which may be substituted, an aralkyl group, an aryl group, a heterocyclic group, or hydrogen), a cyano group, a nitro group, a halogen, hydrogen, an aryl group which may be substituted, or a heterocyclic group; when both $R_2$ and $R_3$ are hydrogen and n≦3, $R_1$ represents an aralkyl group which may be substituted, an aryl group, a heterocyclic group, —O—$R_9$ (wherein $R_9$ represents an aralkyl group which may be substituted, an aryl group, or hydrogen), a cyano group, or a nitro group; and when both $R_2$ and $R_3$ are hydrogen and n>3, $R_1$ represents an alkyl group which may be substituted, an aralkyl group, an aryl group, a heterocyclic group, —O—$R_8$, a cyano group, a nitro group, a halogen, or hydrogen, n=1 to 5, m=1 to 5, and l=1 to 5.

6. A receptor according to claim 1, wherein said charge transporting substance is a compound represented by the following formula:

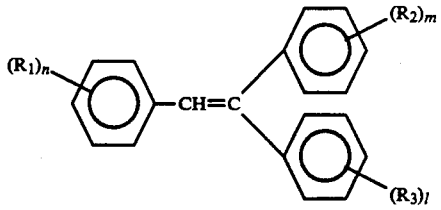

wherein each of $R_2$ and $R_3$ represents an alkyl group which may be substituted, an aralkyl group, —O—$R_4$ (wherein $R_4$ represents an alkyl group which may be substituted, an aralkyl group, an aryl group, or a heterocyclic group),

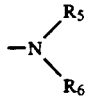

(wherein each of $R_5$ and $R_6$ represents an alkyl which may be substituted, an aralkyl group, or an aryl group, or $R_5$ and $R_6$ together form an N-containing heterocyclic ring), hydrogen, or a halogen group, when neither $R_2$ nor $R_3$ is hydrogen, n=1, at least one of $R_2$ and $R_3$ is

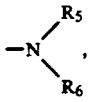

and neither R2 nor R3 is not less than two

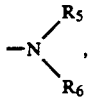

R1 represents an alkyl group in which C≧3 and which may be substituted, —O—$R_7$ (wherein $R_7$ represents an alkyl group in which C≧3 and which may be substituted, an aralkyl group, a heterocyclic group, or hydrogen), a halogen, or an aryl group which may be substituted; when neither $R_2$ nor $R_3$ is hydrogen, n=1, and at least one of $R_2$ and $R_3$ is not less than two

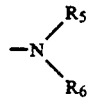

or neither $R_2$ nor $R_3$ is

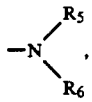

$R_1$ represents an alkyl group in which C≧2 and which may be substituted, —O—$R_7$, a halogen, or hydrogen; and when neither $R_2$ nor $R_3$ is hydrogen and n≧2, $R_1$ represents an alkyl group which may be substituted, an aralkyl group, —O—$R_8$ (wherein $R_8$ represents an alkyl group which may be substituted, an aralkyl group, an aryl group, a heterocyclic group, or hydrogen), a halogen, or hydrogen, n=1 to 5, m=1 to 5, and l=1 to 5.

7. A receptor according to claim 1, wherein said charge transporting substance is a compound represented by the following formula:

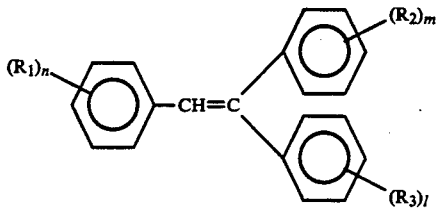

wherein each of $R_2$ and $R_3$ represents —O—$R_4$ (wherein $R_4$ represents an alkyl group which may be substituted, an aralkyl group, an aryl group, or a heterocyclic group),

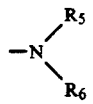

(wherein each of $R_5$ and $R_6$ represents an alkyl group which may be substituted, an aralkyl group, or an aryl group, or $R_5$ and $R_6$ together form an N-containing heterocyclic ring), or hydrogen, when neither $R_2$ nor $R_3$ is hydrogen, n=1, at least one of $R_2$ and $R_3$ is

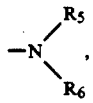

and neither $R_2$ nor $R_3$ is not less than two

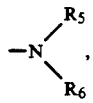

$R_1$ represents an alkyl group in which C≧3 and which may be substituted, —O—$R_7$ (wherein $R_7$ represents an alkyl group in which C≧3 and which may be substituted, an aralkyl group, a heterocyclic group, or hydrogen), or a halogen; when neither $R_2$ nor $R_3$ is hydrogen, n=1, and at least one of $R_2$ and $R_3$ is not less than two

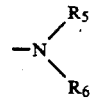

or neither $R_2$ nor $R_3$ is

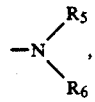

$R_1$ represents an alkyl group in which C≧2 and which may be substituted, —O—$R_7$, or hydrogen; when neither $R_2$ nor $R_3$ is hydrogen and n≧2, $R_1$ represents an alkyl group which may be substituted, an aralkyl group, —O—$R_8$ (wherein $R_8$ represents an alkyl group which may be substituted, an aralkyl group, an aryl group, a heterocyclic group, or hydrogen), or a halogen, n=1 to 5, m=1 to 5, and l=1 to 5.

8. A receptor according to claim 1, wherein said photoconductive layer is constituted by a charge generating layer containing a charge generating substance and a charge transporting layer containing a charge transporting substance.

9. A receptor according to claim 8, wherein said charge generating layer and/or charge transporting layer are/is, constituted by not less than two layers.

10. A receptor according to claim 8, wherein a thickness of said charge generating layer is 0.01 to 20 μm.

11. A receptor according to claim 8, wherein a thickness of said charge generating layer is 0.2 to 5 μm.

12. A receptor according to claim 8, wherein a thickness of said charge transporting layer is 10 to 30 μm.

13. A receptor according to claim 8, wherein a total thickness of said charge generating and transporting layers is not more than 100 μm.

14. A receptor according to claim 8, wherein a total thickness of said charge generating and transporting layers is 10 to 30 μm.

15. A receptor according to claim 1, further comprising an adhesive layer between said conductive support and said photoconductive layer.

16. An electrophotographic receptor comprising:

a conductive support; an a photoconductor layer formed on said conductive support and constituted by a charge generating layer containing a charge generating substance and a charge transporting layer containing a charge transporting substance, wherein a minimum electric field strength required for a waveform, which indicates a change in photocurrent generated when a voltage is applied to and a light pulse is radiated on said photoconductive layer with respect to a time, to have a single peak and an upwardly projecting shape is not more than 200 kv/cm, and said charge transporting substance is a compound represented by the following formula:

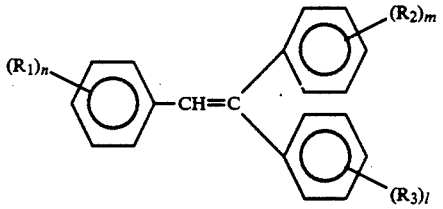

wherein each of $R_2$ and $R_3$ represents —O—$R_4$ (wherein $R_4$ represents an alkyl group which may be substituted, an aralkyl group, an aryl group, or a heterocyclic group),

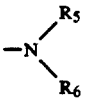

(wherein each of $R_5$ and $R_6$ represents an alkyl group which may be substituted, an aralkyl group, or an aryl group, or $R_5$ and $R_6$ together form an N-containing heterocyclic ring), or hydrogen, when neither $R_2$ nor $R_3$ is hydrogen, n=1, at least one of $R_2$ and $R_3$ is

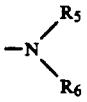

and neither $R_2$ nor $R_3$ is not less than two

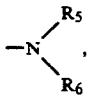

$R_1$ represents an alkyl group in which C≧3 and which may be substituted, —O—$R_7$ (wherein $R_7$ represents an alkyl group in which C≧3 and which may be substituted, an aralkyl group, a heterocyclic group, or hydrogen), or a halogen; when neither $R_2$ nor $R_3$ is hydrogen, n=1, and at least one of $R_2$ and $R_3$ is not less than two

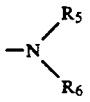

or neither $R_2$ nor $R_3$ is

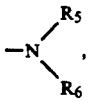

$R_1$ represents an alkyl group in which C≧2 and which may be substituted, —O—$R_7$, or hydrogen, when neither $R_2$ nor $R_3$ is hydrogen and n≧2, $R_1$ represents an alkyl group which may be substituted, an alkyl group, —O—$R_8$ (wherein $R_8$ represents an alkyl group which may be substituted, an aralkyl group, an aryl group, a heterocyclic group, or hydrogen), or a halogen, n=1, to 5, m=1 to 5, and l=1 to 5.

* * * * *